US006927733B2

(12) United States Patent
Noro et al.

(10) Patent No.: US 6,927,733 B2
(45) Date of Patent: Aug. 9, 2005

(54) ANTENNA APPARATUS

(75) Inventors: Junichi Noro, Akita (JP); Kenichi Taguchi, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/785,937

(22) Filed: Feb. 26, 2004

(65) Prior Publication Data

US 2004/0257281 A1 Dec. 23, 2004

(30) Foreign Application Priority Data

Jun. 17, 2003 (JP) ..... P.2003-172542

(51) Int. Cl.[7] ..... H01Q 1/24
(52) U.S. Cl. ..... 343/702; 343/846
(58) Field of Search ..... 343/702, 846; H01Q 1/24

(56) References Cited

U.S. PATENT DOCUMENTS 6,292,148 B1 * 9/2001 Matsuura et al. ..... 343/702

2004/0027295 A1 * 2/2004 Huber et al. ..... 343/702

* cited by examiner

*Primary Examiner*—Don Wong
*Assistant Examiner*—Binh Van Ho
(74) *Attorney, Agent, or Firm*—Whitham, Curtis & Christofferson, PC

(57) ABSTRACT

To provide an antenna apparatus having high reliability without applying a stress to a portion of a grounding spring bonded with an LNA board.

An antenna unit 3 is mounted on one race of an antenna board 4 and an LNA board 1 is mounted on other face of the antenna board 4 and attached with a shield case 6 to cover the LNA board 1. The LNA board 1 is attached with a grounding spring 5 such that a front end thereof is brought into contact with an inner face of the shield case 6. The grounding spring is a grounding spring of a press spring type a base end portion which is pressed to a side of the LNA board 1 by a press force exerted to the front end. When the front end of the grounding spring 5 is brought into press contact with the inner face of the shield case 6 by an elastic force, the press force is operated to press the base end portion of the grounding spring 5 to the side of the LNA board 1.

4 Claims, 3 Drawing Sheets

ANTENNA APPARATUS

BACKGROUND OF THE INVENTION

1. Field of Invention

The present invention relates to an antenna apparatus having an LNA board, particularly relates to an improvement in a grounding spring provided to stabilize to ground an input of the LNA board.

2. Description of the Related Art

Conventionally, there has widely been spread a system, so-to-speak a car navigation system for inducing to guide an advancing path or the like of one's own vehicle for a driver of an automobile. According to the car navigation system, whereas a current position is specified by a speed, a running distance or the like of one's own vehicle, in order to promote positional accuracy, radio wave transmitted from a GPS satellite is received by a GPS antenna and the current position is specified also by positional information acquired from the received radio wave.

Or, in recent years, in the United States or the like, it has been promoted to provide digital radio broadcast or the like by radio wave transmitted from an artificial satellite. Also in a digital radio receiving system for receiving such a digital radio broadcast, an antenna for receiving radio wave transmitted from the satellite is also needed and a so-to-speak satellite radio receiving antenna is used.

The above-described GPS antenna or satellite radio receiving antenna is constituted by an antenna portion and an LNA (Low Noise Amp) portion, normally, attached with an antenna unit at an antenna board and attached with an LNA board formed with an LNA circuit on a rear side of the antenna board and is mounted to a roof or the like of an automobile in a state of containing the boards in a cover member.

Here, with an object for preventing noise or the like from invading, the LNA board is covered with a shield case and attached with a grounding spring to stabilize to ground an input of the LNA circuit. FIG. 6 shows a constitution example of an antenna apparatus of a prior art. An antenna board 101 is attached with an antenna unit 102 on one face thereof and attached with an LNA board 103 on other face thereof and is attached with a shield case 104 to cover the LNA board 103. The LNA board 103 is attached with a grounding spring 105 to achieve to stabilize to ground an input thereof for bringing a front end thereof into contact with an inner face of the shield case 104.

Meanwhile, there is normally used the grounding spring 105 constituted by skewdly folding back a metal piece in a flat plate shape, one end side thereof is brought into contact with the shield case and other end side thereof is soldered to the LNA board 103. At this occasion, a front end 105*a* of the grounding spring 105 is brought into press contact with the inner face of the shield case 104 by an elastic force and as shown by FIG. 7, a press force is exerted in an arrow mark A direction. Then, a portion thereof soldered to the LNA board 103 is exerted with a force in an arrow mark C direction by constituting a fulcrum by a point B (in a direction of peeling off the grounding spring 105). Therefore, a stress is applied to a portion of the grounding spring 105 bonded to the LNA board 103 to thereby pose a serious problem in view of reliability.

SUMMARY OF THE INVENTION

The invention has been proposed to resolve such a drawback provided to the structure of the prior art and it is an object thereof to provide an antenna apparatus having high reliability without applying a stress to a portion of a grounding spring bonded to an LNA board.

In order to achieve the above-described object, an antenna apparatus according to the invention is characterized in an antenna apparatus constituted by mounting an antenna unit on one face of an antenna board, mounting an LNA board on other face of the antenna board and attaching a shield case to cover the LNA board, wherein a grounding spring is attached to the LNA board such that a front end thereof is brought into contact with an inner face of the shield case, and the grounding spring is a grounding spring of a press spring type a base end portion of which is pressed to a side of the LNA board by a press force exerted to a front end thereof.

According to the antenna apparatus of the invention, when the front end of the grounding spring is brought into press contact with the inner face of the shield case by an elastic force to generate a press force, the press force is operated to press the base end portion of the grounding spring to the side of the LNA board. Therefore, a force is not exerted in a direction of peeling off the grounding spring and a stress is not applied to a portion of the grounding spring bonded with the LNA board.

DESCRIPTION OF THE PREFERRED EMBODIMENTS

A detailed explanation will be given of antenna apparatus to which the invention is applied in reference of the drawings as follows.

Figure 1:
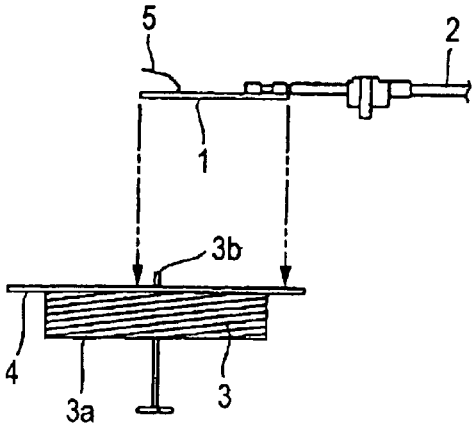
FIG. 1 illustrates views showing steps of integrating an antenna apparatus to which the invention is applied, FIG. 1(*a*) shows a step of positioning an LNA board and an antenna board, FIG. 1(*b*) shows a step of attaching the antenna board and the LNA board, FIG. 1(*c*) shows a step of positioning a shield case, and FIG. 1(*d*) shows a step of attaching the shield case, respectively.
Figure 1:
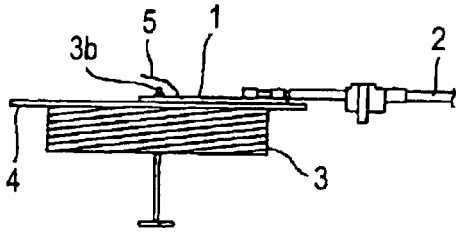
Figure 1:
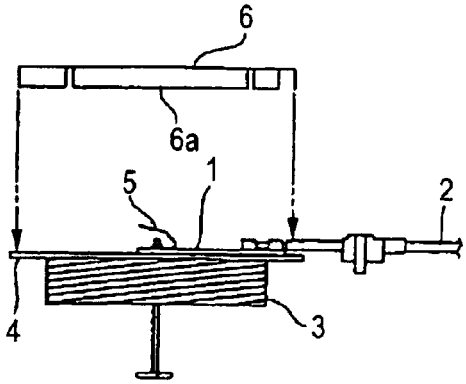
Figure 1:
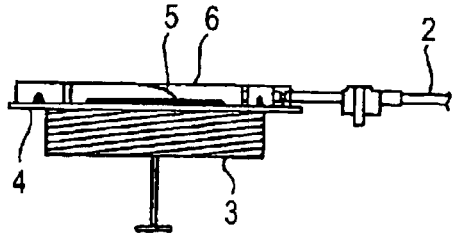

FIG. 1 illustrates views showing a series of steps of integrating an antenna apparatus to which the invention is applied. In order to integrate the antenna apparatus, first, as shown by FIG. 1(*a*), there are prepared an LNA board 1 fixedly soldered with a cable 2, and an antenna board 4 mounted with an antenna unit 3.

The antenna unit 3 is constituted by forming an antenna conductor 3*a* in a spiral shape at a peripheral face of a dielectric member in a cylindrical shape and implanting a pole antenna 3*b* at a center thereof and is mounted to the antenna board 4 by a method of soldering necessary portions or the like.

The LNA board 1 is a board mounted with an LNA circuit constituted by, for example, a first stage amplifier (LNA= low noise amplifier), a band pass filter, and a second stage amplifier (LNA=low noise amplifier) and is constituted by forming a predetermined wiring pattern on an ordinary rigid board and mounting predetermined parts thereon.

Figure 2:
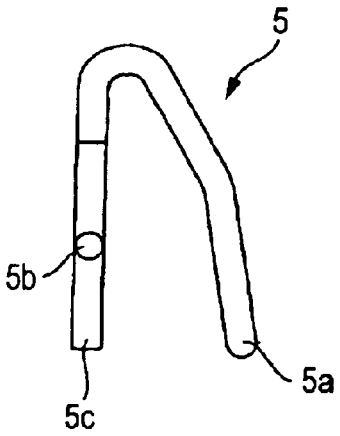
FIG. 2 illustrates views showing a shape of a grounding spring, FIG. 2(*a*) is a side view and FIG. 2(*b*) is a plane view.
Figure 2:
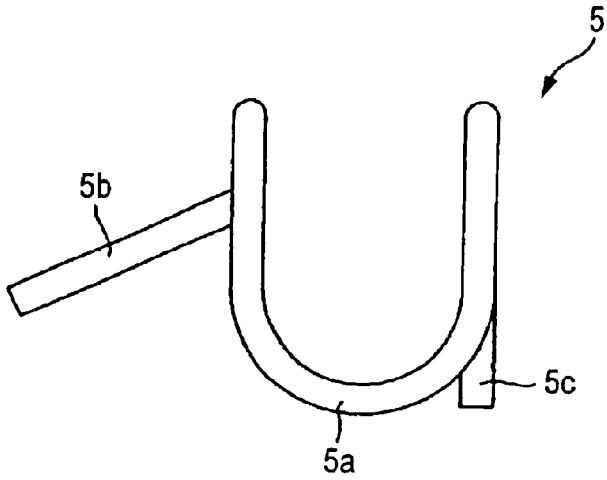

The LNA board 1 is attached with a grounding spring 5 brought into contact with a shield case, mentioned later, to achieve to stabilize to ground an input thereof. As shown by FIG. 2, the grounding spring 5 comprises a U-like shape portion 5*a* and grounding portions 5*b*, 5*c* constituted by folding back both ends thereof, the U-like shape portion 5*a* is brought into contact with an inner face of the shield case and the grounding portions 5*b*, 5*c* are fixedly soldered to the LNA board 1. Further, according to the example, the grounding portion 5*b* on one side is folded to bend skewdly in an in-face direction of the LNA board 1 to thereby achieve to stabilize a state of being attached to the LNA board 1.

Figure 3:
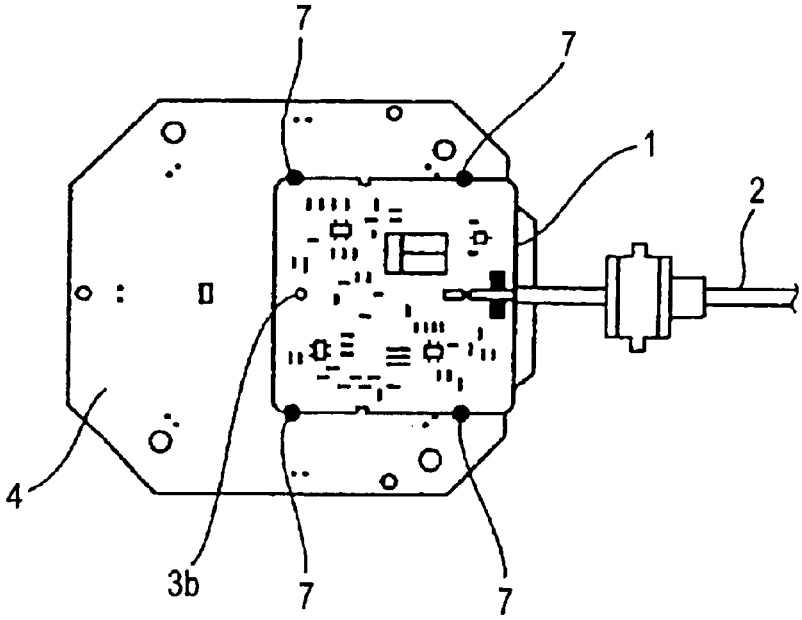
FIG. 3 is a plane view showing a state of attaching the LNA board to the antenna board.

Next, as shown by FIG. 1(*b*) the LNA board 1 is attached to the antenna board 4. At this occasion, according to the embodiment, as shown by FIG. 3, the boards are fixed by soldering end face through holes 7 provided at four locations of a surrounding or the LNA board 1 and at the same time, a GND pattern of the antenna board 4 and a GND pattern of the LNA board 1 are also connected.

Further, in attaching the LNA board 1 to the antenna board 4, at a region surrounded by the U-like shape portion 6*a* of the grounding spring 5, the pole antenna 3*b* of the antenna unit 3 is connected to the LNA board 1. The grounding spring 5 is arranged to surround the pole antenna 3*b* centering thereon to stabilize a structure of attaching the antenna unit 3, the LNA board 1 and the shield case.

After attaching the LNA board 1, as shown by FIG. 1(*c*), a shield case 6 is covered on the side of the LNA board 1 to thereby finish the antenna apparatus as shown by FIG. 1(*d*). The shield case 6 is provided with positioning tabs 6*a* at a plurality of locations (for example, three locations) and is fixedly positioned to the antenna board 4 by fitting the positioning tabs to positioning holes formed at the antenna board 4 to solder.

Figure 4:
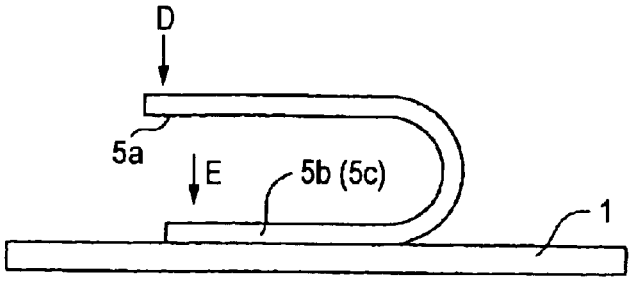
FIG. 4 is a view showing a press force exerted to the grounding spring.

When the shield case 6 is covered to the LNA board 1, the U-like shape portion 6*a* is brought into contact With the inner race of the shield case 6. At this occasion, the grounding spring 5 is brought into the form of being pressed by the inner face of the shield case 6 and as shown by FIG. 4, the U-like shape portion 5*a* or the grounding spring 5 is exerted with a press force in an arrow mark D direction of the drawing. Therefore, although the grounding portions 5*b*, 5*c* of the grounding spring 5 are exerted with the press force, the press force exerted to the grounding portions 5*b*, 5*c* is operated to press the grounding portions 5*b*, 5*c* to the side of the LNA board 1 as shown by an arrow mark E. Therefore, a stress is not applied to a portion of the grounding spring 5 bonded with the LNA board 1 and a function of the grounding spring 5 is ensured over a long period of time.

The finished antenna apparatus is contained in a cover member or the like and is mounted to the roof or the like or an automobile.

Figure 5:
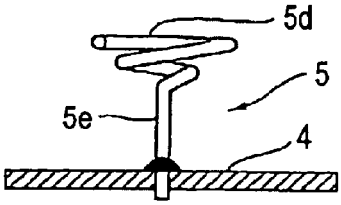
FIG. 5 is an outline perspective view showing other example of the grounding spring.
Figure 6:
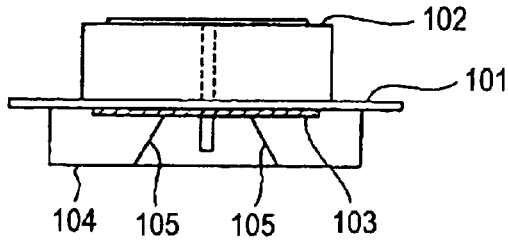
FIG. 6 is a view showing an example or an antenna apparatus of a prior art.
Figure 7:
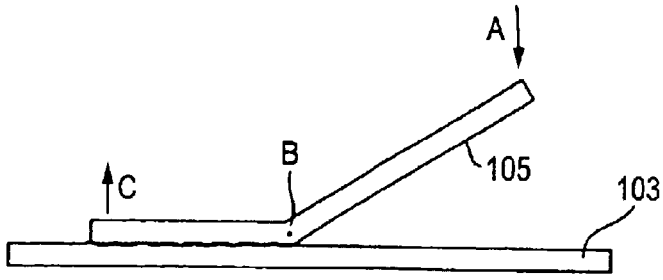
FIG. 7 is a view showing a press force exerted to the grounding spring of the prior art.

Although an explanation has been given of the antenna apparatus to which the invention is applied as described above, the invention is not naturally limited to the embodiment. For example, the shape of the grounding spring 5 is not limited to that of the prior example shown in FIG. 2 but may be constituted by a spring portion 5*d* in a spiral shape and a support pin portion 5*e* for being attached to the LNA board 1 as shown by FIG. 5. In this case, the grounding spring 5 is mounted thereto by implanting the support pin portion 5*e* to the LNA board 1 and when the spring portion 5*d* is exerted with the press force, the press force is operated to press the support pin portion 5*e* to the LNA board 1 and therefore, invariably, a stress for detaching the grounding spring 5 is not applied thereto.

As is apparent from the above-described explanation, according to the antenna apparatus of the invention, an antenna apparatus having high reliability can be provided without applying a stress to the portion of the grounding spring bonded with the LNA board.

What is claimed is:

1. An antenna apparatus, comprising:

a first board member, comprising an antenna unit; a second board member, provided on the first board member and comprising an LNA circuit;

a shield case, covering the second board member;

an earth wire, grounds the LNA circuit through the shield case, the earth wire having, a first portion, brought into elastic contact with the shield case, a second portion, connected with the first portion and the second member, and wherein the earth wire is arranged such that the first portion is elastically pressed from the shield case and the second portion is pressed against the second board member in the first direction.

2. The antenna apparatus according to claim 1, wherein the first portion is formed as U shaped member viewed from an upper part of the shield case.

3. The antenna apparatus according to claim 2, wherein the antenna unit and the LNA circuit are electrically connected under a region surrounded by the first portion formed as U shaped member.

4. The antenna apparatus according to claim 1, wherein the first portion is formed in a spiral shape, and the second portion is a pin implanted to the second board member.

* * * * *